US008783368B2

(12) United States Patent
Eriksen et al.

(10) Patent No.: US 8,783,368 B2
(45) Date of Patent: Jul. 22, 2014

(54) WELL TOOL WITH SHEARABLE COLLET

(75) Inventors: Erik P. Eriksen, Calgary (CA); Barry J. Tate, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 176 days.

(21) Appl. No.: 12/985,107

(22) Filed: Jan. 5, 2011

(65) Prior Publication Data

US 2012/0168178 A1 Jul. 5, 2012

(51) Int. Cl.
*E21B 23/00* (2006.01)

(52) U.S. Cl.
USPC ..... 166/382; 166/208; 166/181; 166/125; 166/123

(58) Field of Classification Search
USPC ..... 166/382, 208, 380, 125, 123, 138, 181
See application file for complete search history.

(56) References Cited

U.S. PATENT DOCUMENTS

| | | | |
|---|---|---|---|
| 3,785,193 | A | 1/1974 | Kinley et al. |
| 4,911,237 | A | 3/1990 | Melenyzer |
| 4,913,229 | A | 4/1990 | Hearn |
| 6,739,398 | B1 | 5/2004 | Yokley et al. |
| 7,686,090 | B2 | 3/2010 | Reimert et al. |
| 2009/0101345 | A1 | 4/2009 | Moffitt et al. |
| 2009/0107675 | A1 | 4/2009 | Eriksen et al. |
| 2009/0107687 | A1 | 4/2009 | Combs et al. |
| 2010/0084141 | A1* | 4/2010 | Gazewood ..... 166/377 |

FOREIGN PATENT DOCUMENTS

| | | | |
|---|---|---|---|
| GB | 2 376 252 | A2 | 12/2002 |

OTHER PUBLICATIONS

International Search Report and Written Opinion dated Apr. 16, 2012, International Application No. PCT/ CA2011/001430, 11 pages.

* cited by examiner

*Primary Examiner* — Kenneth L Thompson
*Assistant Examiner* — Taras P Bemko
(74) *Attorney, Agent, or Firm* — Osha Liang LLP

(57) ABSTRACT

A running tool for well drilling operations is carried by a running string into and out of a wellbore. A collet is carried by the running tool, the collet having fingers with a radially expanded position arranged to latch against a wellbore shoulder in the wellbore. The fingers are resiliently and radially contractible. A shear element is carried by the collet, the shear element preventing the fingers from radially contracting to unlatch the running tool while the shear element is intact. If a selected axial force is applied against the shear element, it shears, freeing the collet fingers to retract. The collet may be part of a tool to set and release a liner hanger from engagement with a string of casing.

20 Claims, 8 Drawing Sheets

WELL TOOL WITH SHEARABLE COLLET

FIELD OF THE INVENTION

This invention relates in general to oil and gas well drilling while simultaneously installing a liner in the well bore, and in particular to a running tool having a collet latch with shear elements to set a liner hanger.

BACKGROUND OF THE INVENTION

Oil and gas wells are conventionally drilled with drill pipe to a certain depth, then casing is run and cemented in the well. The operator may then drill the well to a greater depth with drill pipe and cement another string of casing. In this type of system, each string of casing extends to the surface wellhead assembly.

In some well completions, an operator may install a liner rather than an inner string of casing. The liner is made up of joints of pipe in the same manner as casing. Also, the liner is normally cemented into the well. However, the liner does not extend back to the wellhead assembly at the surface. Instead, it is secured by a liner hanger to the last string of casing just above the lower end of the casing. The operator may later install a tieback string of casing that extends from the wellhead downward into engagement with the liner hanger assembly.

When installing a liner, in most cases, the operator drills the well to the desired depth, retrieves the drill string, then assembles and lowers the liner into the well. A liner top packer may also be incorporated with the liner hanger. A cement shoe with a check valve will normally be secured to the lower end of the liner as the liner is made up. When the desired length of liner is reached, the operator attaches a liner hanger to the upper end of the liner, and attaches a running tool to the liner hanger. The operator then runs the liner into the wellbore on a string of drill pipe attached to the running tool. The operator sets the liner hanger and pumps cement through the drill pipe, down the liner and back up an annulus surrounding the liner. The cement shoe prevents backflow of cement back into the liner. The running tool may dispense a wiper plug following the cement to wipe cement from the interior of the liner at the conclusion of the cement pumping. The operator then sets the liner top packer, if used, releases the running tool from the liner, and retrieves the drill pipe.

A variety of designs exist for liner hangers. Some may be set in response to mechanical movement or manipulation of the drill pipe, including rotation. Others may be set by dropping a ball or dart into the drill string, then applying fluid pressure to the interior of the string after the ball or dart lands on a seat in the running tool. The running tool may be attached to the liner hanger or body of the running tool by threads, shear elements, or by a hydraulically actuated arrangement.

In another method of installing a liner, the operator runs the liner while simultaneously drilling the wellbore. This method is similar to a related technology known as casing drilling. One technique employs a drill bit on the lower end of the liner. One option is to not retrieve the drill bit, rather cement it in place with the liner. If the well is to be drilled deeper, the drill bit would have to be a drillable type. This technique does not allow one to employ components that must be retrieved, which might include downhole steering tools, measuring while drilling instruments and retrievable drill bits. Retrievable bottom hole assemblies are known for casing drilling, but in casing drilling, the upper end of the casing is at the rig floor. In typical liner drilling, the upper end of the liner is deep within the well and the liner is suspended on a string of drill pipe. In casing drilling, the bottom hole assembly can be retrieved and rerun by wire line, drill pipe, or by pumping the bottom hole assembly down and back up. With liner drilling, the drill pipe that suspends the liner is much smaller in diameter than the liner and has no room for a bottom hole assembly to be retrieved through it. Being unable to retrieve the bit for replacement thus limits the length that can be drilled and thus the length of the liner. If unable to retrieve and rerun the bottom hole assembly, the operator would not be able to liner drill with expensive directional steering tools, logging instruments and the like, without planning for removing the entire liner string to retrieve the tools.

If the operator wishes to retrieve the bottom hole assembly before cementing the liner, there are no established methods and equipment for doing so. Also, if the operator wishes to rerun the bottom hole assembly and continue drilling with the liner, there are no established methods and equipment for doing so.

One difficulty to overcome in order to retrieve and rerun a bottom hole assembly during liner drilling concerns how to keep the liner from buckling if it is disconnected from the drill pipe and left in the well. If the liner is set on the bottom of the well, at least part of the drilling bottom hole assembly could be retrieved to replace a bit or directional tools. But, there is a risk that the liner might buckle due to inadequate strength to support its weight in compression. A liner hanger, if set in a pre-existing casing string, would support the weight of the string of liner.

Proposals are shown in patent art to set a liner hanger in casing, retrieve the bottom hole assembly, then re-run the bottom hole assembly. For example, in US published patent application 2009/0107687, published Apr. 30, 2009, a running tool with a collet latch is used to latch into the liner hanger. When retrieving the bottom hole assembly, the running tool strokes the collet to set the liner hanger, then releases the collet from the liner hanger. While feasible, controlling the force at which the collet releases from the set liner hanger is difficult.

SUMMARY

In one embodiment, a collet is carried by a running tool. The collet has fingers with a radially expanded position arranged to latch against a wellbore shoulder in the wellbore. The fingers are resiliently and radially contractible to unlatch the running tool. A shear element is carried by the collet, the shear element preventing the fingers from radially contracting to unlatch the running tool while the shear element is intact. If a selected axial force is applied against the shear element, causing the shear element to shear, the fingers are free to retract.

In one embodiment, the running tool has a hydraulic mechanism operable in response to hydraulic fluid pressure applied to the running string to exert the selected axial force on the shear element. Preferably, each of the fingers has an upward-facing shoulder. Each shear elements is mounted to one of the fingers and has a head that protrudes radially outward from the finger for engagement with the wellbore shoulder. At least a portion of the shear element head is located above the upward-facing shoulder. An axially extending elongated slot may extend downward from each of the shear elements within the fingers to receive the head after it has been sheared. Each of the shear elements may comprise a pin with an inner end flush with an inner surface of the collet. The fingers are free to radially contract and snap past the wellbore shoulder with the shear element intact when the running tool moves downward in the wellbore relative to the wellbore shoulder.

In an exemplary embodiment, the running tool releasably latches to a liner hanger having a lower end configured to be secured to the string of liner. The liner hanger has a set of slips, the slips being radially movable between a set position in engagement with a casing string in the wellbore and a disengaged position in response to axial movement of the slips relative to the liner hanger. The collet or latch is carried by and axially movable relative to a mandrel of the running tool. The latch has a latched position latched to the slips while the running tool is coupled to the string of liner. The shear element is mounted to the latch, and while intact, it will limit further axial movement of the latch after the slips have expanded. After being sheared, the latch can continue axial movement to release the latch from engagement with the slips.

DETAILED DESCRIPTION OF THE INVENTION

Figure 1:
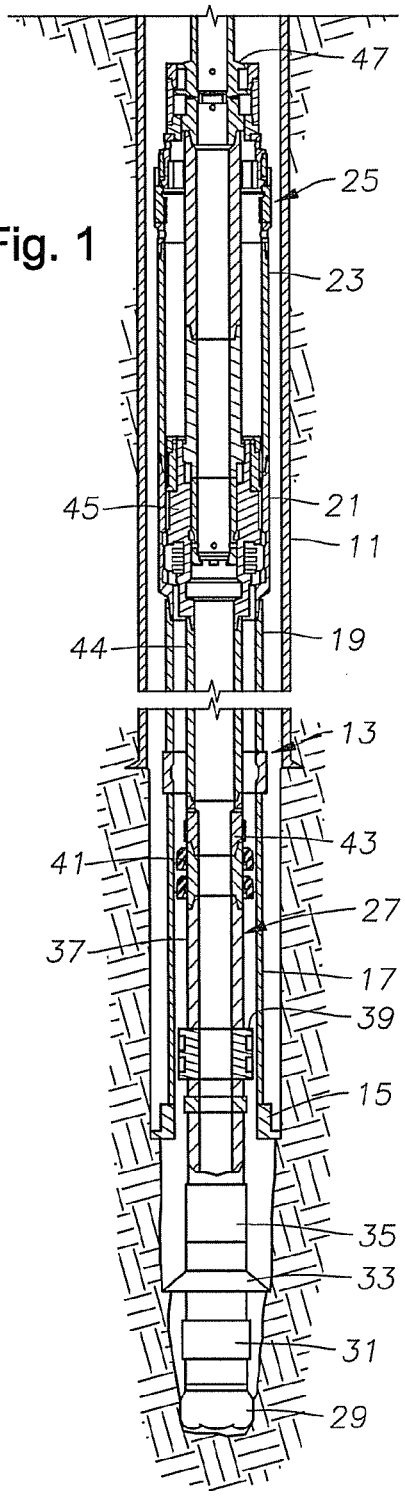
FIG. 1 is a schematic sectional view of inner and outer concentric strings during drilling.

Referring to FIG. 1, a well is shown having a casing 11 that is cemented in place. An outer string 13 is located within casing 11 and extends below to an open hole portion of the well. In this example, outer string 13 is made up of a drill shoe 15 on its lower end that may have cutting elements for reaming out the well bore. A tubular shoe joint 17 extends upward from drill shoe 15 and forms the lower end of a string of liner 19. Liner 19 comprises pipe that is typically the same type of pipe as casing, but normally is intended to be cemented with its upper end just above the lower end of casing 11, rather than extending all the way to the top of the well or landed in a wellhead and cemented. The terms "liner" and "casing" may be used interchangeably. Liner 19 may be several thousand feet in length.

Outer string 13 also includes a profile nipple or sub 21 mounted to the upper end of liner 19. Profile nipple 21 is a tubular member having grooves and recesses formed in it for use during drilling operations, as will be explained subsequently. A tieback receptacle 23, which is another tubular member, extends upward from profile nipple 21. Tieback receptacle 23 is a section of pipe having a smooth bore for receiving a tieback sealing element used to land seals from a liner top packer assembly or seals from a tieback seal assembly. Outer string 13 also includes in this example a liner hanger 25 that is resettable from a disengaged position to an engaged position with casing 11. For clarity, casing 11 is illustrated as being considerably larger in inner diameter than the outer diameter of outer string 13, but the annular clearance between liner hanger 25 and casing 11 may be smaller in practice.

An inner string 27 is concentrically located within outer string 13 during drilling. Inner string 27 includes a pilot bit 29 on its lower end. Auxiliary equipment 31 may optionally be incorporated with inner string 27 above pilot bit 29. Auxiliary equipment 31 may include directional control and steering equipment for inclined or horizontal drilling. It may include logging instruments as well to measure the earth formations. In addition, inner string 27 normally includes an underreamer 33 that enlarges the well bore being initially drilled by pilot bit 29. Optionally, inner string 27 may include a mud motor 35 that rotates pilot bit 29 relative to inner string 27 in response to drilling fluid being pumped down inner string 27.

A drill pipe string 37 is attached to mud motor 35 and forms a part of inner string 27. Drill pipe string 37 may be conventional pipe used for drilling wells or it may be other tubular members. During drilling, a portion of drill pipe string 37 will extend below drill shoe 15 so as to place drill bit 29, auxiliary equipment 31 and reamer 33 below drill shoe 15. An internal stabilizer 39 may be located between drill pipe string 37 and the inner diameter of shoe joint 17 to stabilize and maintain inner string 27 concentric.

Optionally, a packoff 41 may be mounted in the string of drill pipe string 37. Packoff 41 comprises a sealing element, such as a cup seal, that sealingly engages the inner diameter of shoe joint 17, which forms the lower end of liner 19. If utilized, pack off 41 forms the lower end of an annular chamber 44 between drill pipe string 37 and liner 19. Optionally, a drill lock tool 45 at the upper end of liner 19 forms a seal with part of outer string 13 to seal an upper end of inner annulus 44. In this example, a check valve 43 is located between pack off 41 and drill lock tool 45. Check valve 43 admits drilling fluid being pumped down drill pipe string 37 to inner annulus 44 to pressurize inner annulus 44 to the same pressure as the drilling fluid flowing through drill pipe string 37. This pressure pushes downward on packoff 41, thereby tensioning drill pipe string 37 during drilling. Applying tension to drill pipe string 37 throughout much of the length of liner 19 during drilling allows one to utilize lighter weight pipe in the lower portion of the string of drill pipe string 37 without fear of buckling.

Preferably, check valve 43 prevents the fluid pressure in annular chamber 44 from escaping back into the inner passage in drill pipe string 37 when pumping ceases, such as when an adding another joint of drill pipe string 37.

Drill pipe string 37 connects to drill lock tool 45 and extends upward to a rotary drive and weight supporting mechanism on the drilling rig. Often the rotary drive and weight supporting mechanism will be the top drive of a drilling rig. The distance from drill lock tool 45 to the top drive could be thousands of feet during drilling. Drill lock tool 45 engages profile nipple 21 both axially and rotationally. Drill lock tool 45 thus transfers the weight of outer string 13 to the string of drill pipe string 37. Also, drill lock tool 45 transfers torque imposed on the upper end of drill pipe string 37 to outer string 13, causing it to rotate in unison.

A liner hanger control tool 47 is mounted above drill lock tool 45 and separated by portions of drill pipe string 37. Liner hanger control tool 47 is a hydraulic mechanism employed to release and set liner hanger 25 and also to release drill lock tool 45. Drill lock tool 45 is located within profile nipple 21 while liner hanger control tool 47 is located above liner hanger 25 in this example.

In brief explanation of the operation of the equipment shown in FIG. 1, normally during drilling the operator rotates drill pipe string 37 at least part of the time, although on some occasions only mud motor 35 is operated, if a mud motor is utilized. Rotating drill pipe string 37 from the drilling rig, such as the top drive, causes inner string 27 to rotate, including drill bit 29. Some of the torque applied to drill pipe string 37 is transferred from drill lock tool 45 to profile nipple 21. This transfer of torque causes outer string 13 to rotate in unison with inner string 27. In this embodiment, the transfer of torque from inner string 27 to outer string 13 occurs only by means of the engagement of drill lock tool 45 with profile nipple 21. The operator pumps drilling fluid down inner string 27 and out nozzles in pilot bit 29. The drilling fluid flows back up an annulus surrounding outer string 13.

If, prior to reaching the desired total depth for liner 19, the operator wishes to retrieve inner string 27, he may do so. In this example, the operator actuates liner hanger control tool 47 to move the slips of liner hanger 25 from a retracted position to an engaged position in engagement with casing 11. The operator then slacks off the weight on inner string 27, which causes liner hanger 25 to support the weight of outer string 13. Using liner hanger control tool 47, the operator also releases the axial lock of drill lock tool 45 with profile nipple 21. This allows the operator to pull inner string 27 while leaving outer string 13 in the well. The operator may then repair or replace components of the bottom hole assembly including drill bit 29, auxiliary equipment 31, underreamer 33 and mud motor 35. The operator also resets liner hanger control tool 47 and drill lock tool 45 for a reentry engagement, then reruns inner string 27. The operator actuates drill lock tool 45 to reengage profile nipple 21 and lifts inner string 27, which causes drill lock tool 45 to support the weight of outer string 13 and release liner hanger 25. The operator reengages liner hanger control tool 47 with liner hanger 25 to assure that its slips remain retracted. The operator then continues drilling. When at total depth, the operator repeats the process to remove inner string 27, then may proceed to cement outer string 13 into the well bore. More details of the various components and their operation are shown in US Published patent application 2009/0107675, published Apr. 30, 2009.

Figure 2:
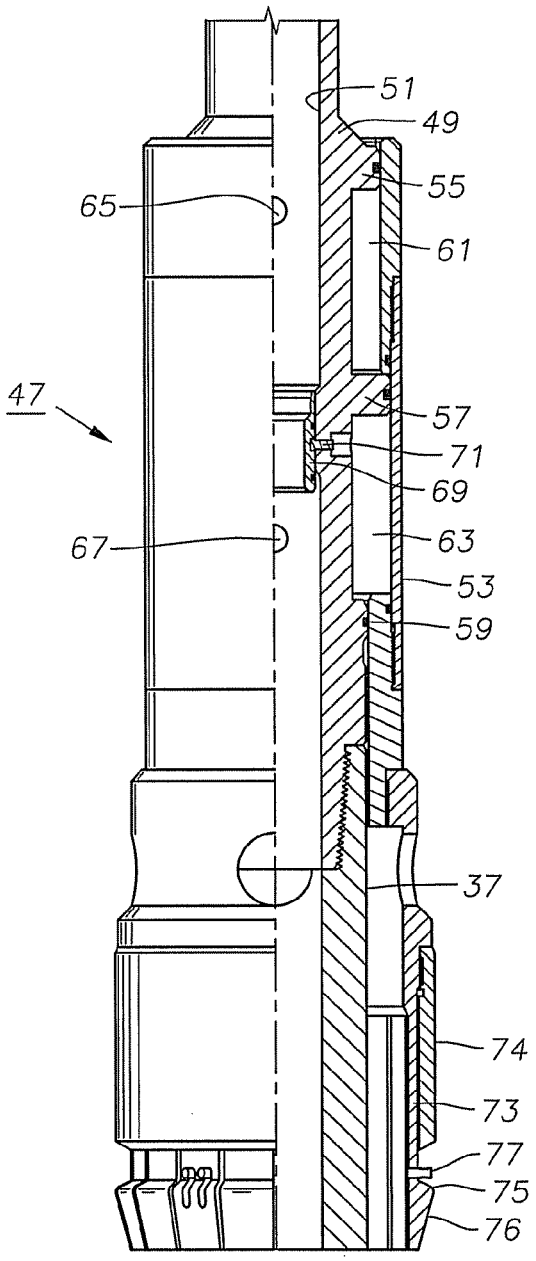
FIG. 2 is an enlarged sectional view of a liner hanger control tool of the system of FIG. 1 and shown in a position employed during drilling.

FIG. 2 illustrates one example of liner hanger control tool 47, which may also be referred to as a running tool. In this embodiment, liner hanger control tool 47 has a tubular mandrel 49 with an axial flow passage 51 extending through it. The lower end of mandrel 49 connects to and fauns a part of drill pipe string 37, which extends down to drill lock tool 45. The upper end of mandrel 49 connects to additional strings of drill pipe string 37 that lead to the drilling rig. An outer housing 53 surrounds mandrel 49 and is axially movable relative to mandrel 49. In this embodiment, an annular upper piston 55 extends around the exterior of mandrel 49 outward into sealing and sliding engagement with outer housing 53. An annular central piston 57, located below upper piston 55, extends outward from mandrel 49 into sliding engagement with another portion of outer housing 53. Outer housing 53 is formed of multiple components in this example, and the portion engaged by central piston 57 has a greater inner diameter than the portion engaged by upper piston 55. An annular lower piston 59 is formed on the exterior of mandrel 49 below central piston 57. Lower piston 59 sealingly engages a lower inner diameter portion of outer housing 53. The portion engaged by lower piston 59 has an inner diameter that is less than the inner diameter of the portion of outer housing 53 engaged by upper piston 55.

Pistons 55, 57, 59 and outer housing 53 define an upper annular chamber 61 and a lower annular chamber 63. An upper port 65 extends between mandrel axial flow passage 51 and upper annular chamber 61. A lower port 67 extends from mandrel axial flow passage 51 to lower annular chamber 63. A seat 69 is located in axial flow passage 51 between upper and lower ports 65, 67. Seat 69 faces upward and preferably is a ring retained by a shear pin 71.

Figure 3:
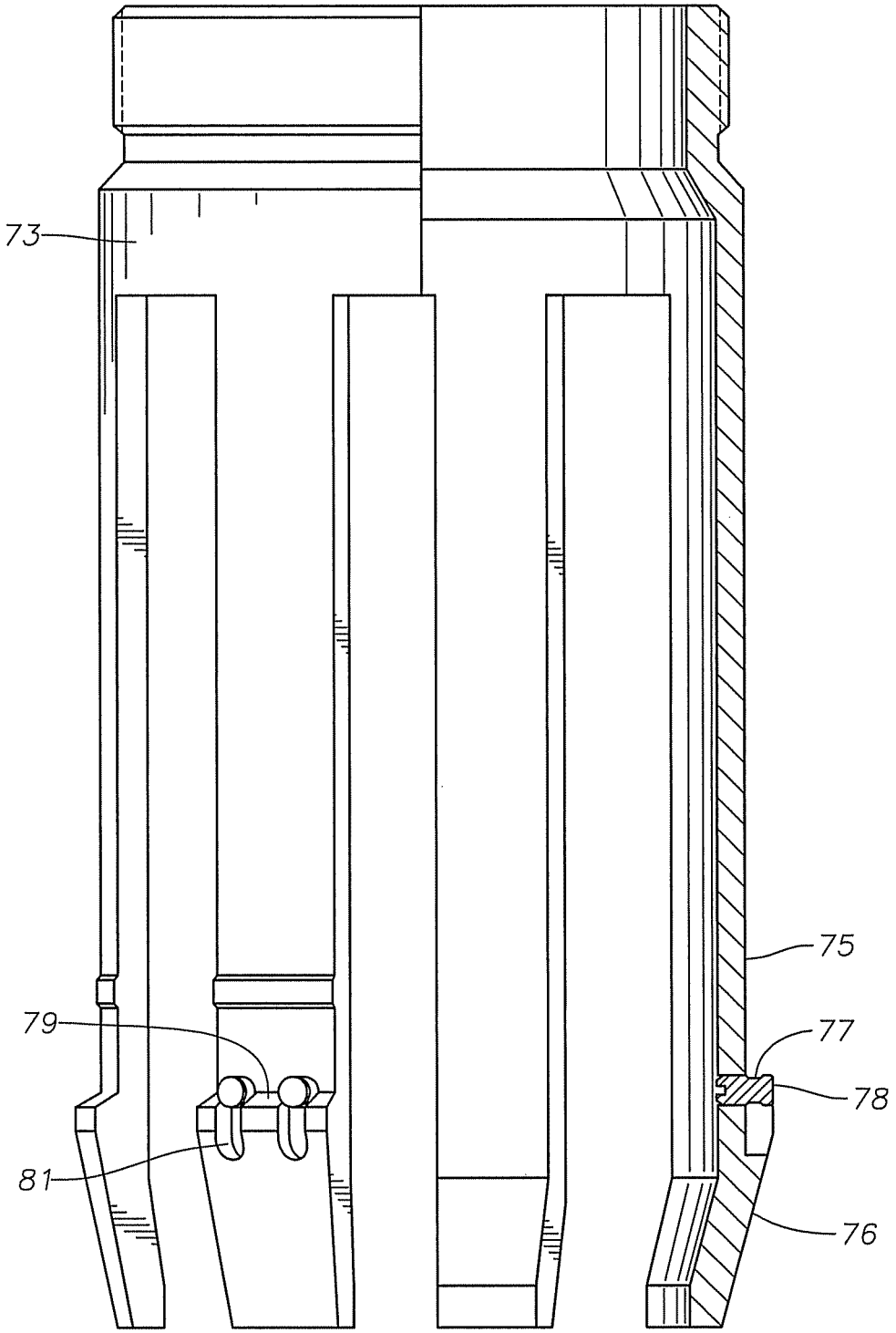
FIG. 3 is an enlarged half-sectional view of a collet incorporated with the liner hanger control tool of FIG. 2.

A latch, which in this example comprises a collet 73, extends into and is secured to outer housing 53. Collet 73 has fingers 75 that depend from axial strips or bands, which are joined to an upper annular band. An external sleeve 74 surrounds an upper portion of fingers 75, and the lower portion protrudes below. Fingers 75 have upward and outward facing external shoulders 79 and are resilient so as to deflect radially inward. An exterior tapered portion 76 of each finger 75 begins at the outer diameter of shoulder 79 and tapers from a larger outer diameter to a smaller outer diameter at the lower end. While in the natural condition of FIG. 2, finger shoulders 79 circumscribe an outer diameter approximately equal to external sleeve 74. Fingers 75 are adapted to engage liner hanger 25 (FIG. 1). Fingers 75 are formed by slots extending partway up collet 73. FIG. 3 shows alternating ones of fingers 75 removed from collet 73, and either the version shown in FIG. 2 or the one shown in FIG. 3 is feasible.

Figure 4:
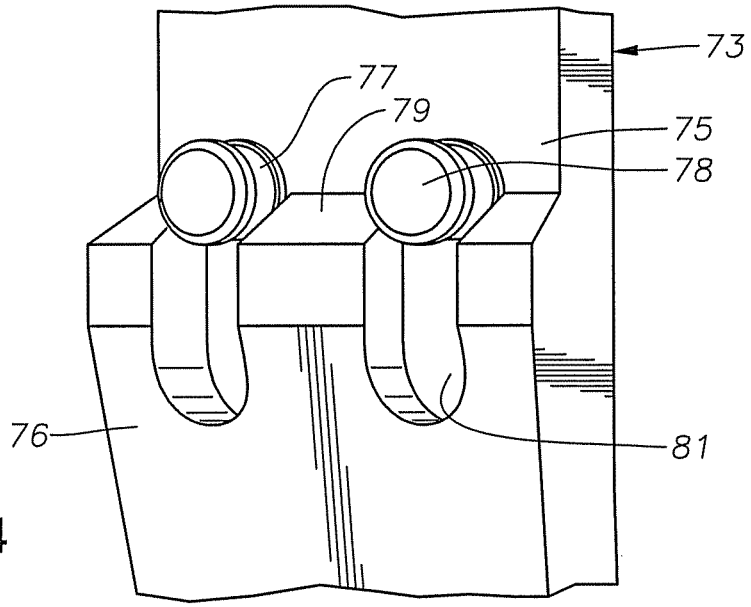
FIG. 4 is a further enlarged side view of a portion of the collet of FIG. 3, showing shear elements.

One or more shear elements 77 are secured to all or some of the fingers 75. In this example, two shear elements 77 are shown mounted to selected ones of fingers 75 around the periphery of collet 73. Each shear element 77 in this example is in the shape of a pin or screw that secures within a hole formed in one of the fingers 75. As shown in FIGS. 3 and 4, each shear element 77 has a head 78 that protrudes radially outward from the exterior surface of one of the fingers 75, relative to a longitudinal axis of collet 73. Head 78 has a length in this example that is approximately equal to the length of the base portion of shear element 77. Head 78 may be generally cylindrical as shown or other shapes. The inner end of each shear element 77 may be substantially flush with an inner surface of finger 75. Each shear elements 77 is secured to only one component, which is one of the collet fingers 75. Shear element 77 is formed of a conventional material for shearing at a selected force applied perpendicular to the axis of shear element 77.

Figure 13:
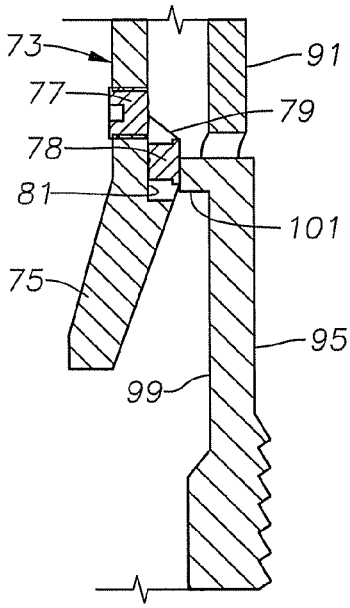
FIG. 13 is an enlarged sectional view illustrating a portion of the collet of FIG. 3 showing a collet finger sliding past a shoulder of a slip of the liner hanger as the collet is disengaging from the liner hanger.

Shear elements 77 are mounted at least slightly above finger shoulder 79. As illustrated in FIG. 4, approximately the upper half of each head 78 may be located above finger shoulder 79 and the lower half at the same elevation as or below finger shoulder 79. Shear elements 77 optionally could be located at a higher elevation relative to shoulders 79 than shown. An elongated slot 81 extends downward within each finger 75 from each shear element 77. Slot 81 need not extend completely through a thickness of finger 75. Slot 81 has a length selected so that after shearing, as illustrated in FIG. 13, head 78 may travel downward within slot 81 so that no portion of head 78 after shearing is above finger shoulder 79. Shear element heads 78 protrude radially outward to a point approximately flush with the outer edge of finger shoulders 79.

Figure 5:
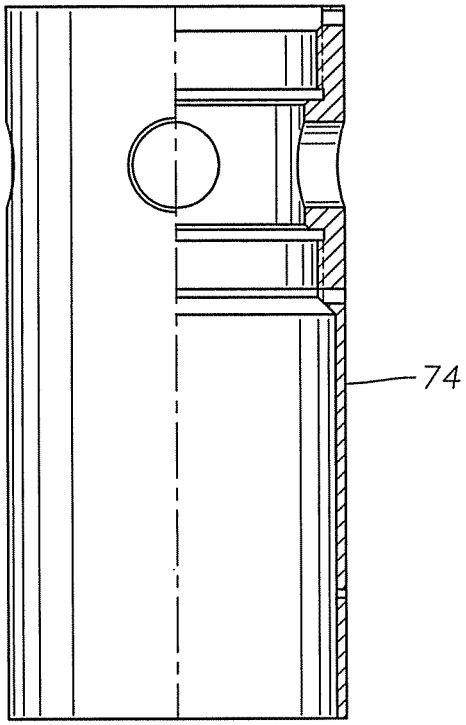
FIG. 5 is a half-sectional view of a sleeve in which the collet of FIG. 3 is carried.

FIG. 5 illustrates a slightly more detailed version of external sleeve 74 than FIG. 2. Collet 73 is secured within external sleeve 74 and moves axially in unison with it. External sleeve 74 is secured to control tool housing 53 (FIG. 2) and moves axially in unison with it.

Figure 6:
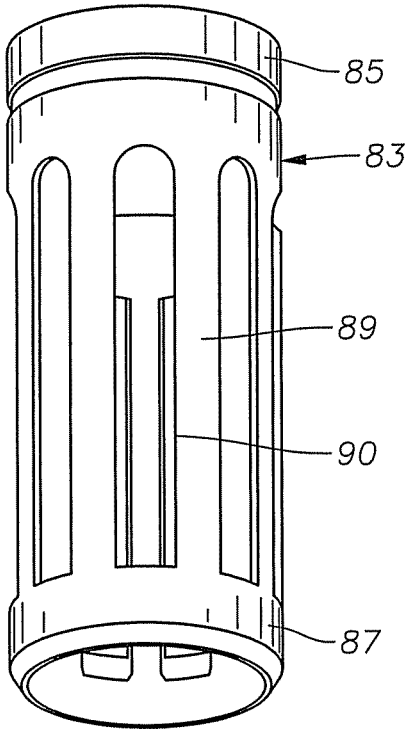
FIG. 6 is a perspective view of collet cage that fits within the collet of FIG. 3.
Figure 7:
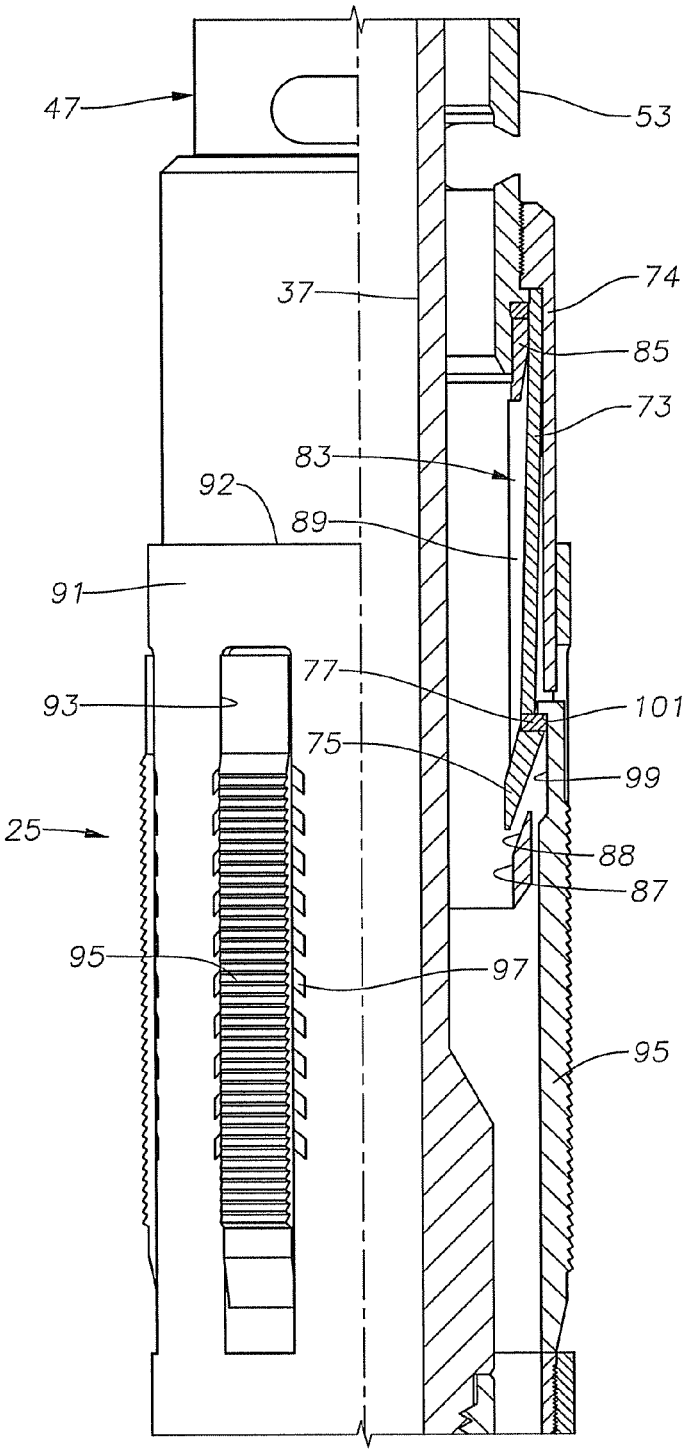
FIG. 7 is an enlarged half-sectional view of a liner hanger of the system of FIG. 1, with the collet of the liner hanger control tool in engagement and the liner hanger being run into a well.

FIG. 6 illustrates a collet retainer or cage 83, which is not shown in FIG. 2 and is used with the embodiment of collet 73 shown in FIG. 3. Cage 83 has a solid upper ring 85, a solid lower ring 87 and a plurality of vertical bands 89 extending between rings 85, 87. Open windows 90 are located between each band 89. In this example, bands 89 are integrally foamed with upper and lower rings 85, 87. Upper and lower rings 85, 87 fit within collet 73, with each finger 75 being located within one of the windows 90, as shown in FIG. 7. In the inward deflected position of FIG. 7, the lower portions of fingers 75 extend radially inward through windows 90. Even when in the inward deflected position, shoulders 79 of fingers 75 are radially outward from the exterior of cage 83. When released from liner hanger 25 (FIG. 2), the inner surfaces of the lower ends of fingers 75 will be within windows 90 but not further radially inward than the inner surface of cage 83.

Lower ring 87 of cage 83 has an inner ramp or cam surface 88 (FIG. 7) that faces upward and inward. When collet 73 is in the run in and drilling position of FIG. 7, the lower ends of collet fingers 75 will be spaced above cam surface 88.

Referring to FIG. 7, liner hanger 25 has an outer housing 91 with an upper rim 92. A plurality of windows 93 are formed in outer housing 91 and spaced around the circumference of outer housing 91. A slip 95 is movably carried within each window 93. Slips 95 are movable between a run-in or drilling position (FIG. 7) and a set position (FIG. 9) relative to housing 91. In the run-in or drilling position, teeth formed on the exteriors of slips 95 circumscribe an outer diameter that is no greater than the outer diameter of liner hanger outer housing 91. In the set position, slips 95 protrude from windows 93, circumscribing a greater outer diameter than outer housing 91. In the set position the teeth of slips 95 will contact casing 11, and when weight is imposed on outer housing 91, the teeth will bit into casing 11. In this embodiment, slips 95 are moved radially outward in response to an axial movement due to cam tabs 97 on each side edge of each slip 95. Cam tabs 97 slide on ramps formed in outer housing 91. In this embodiment, an upward movement of slips 95 relative to outer housing 91 causes them to move to the set position.

Figure 8:
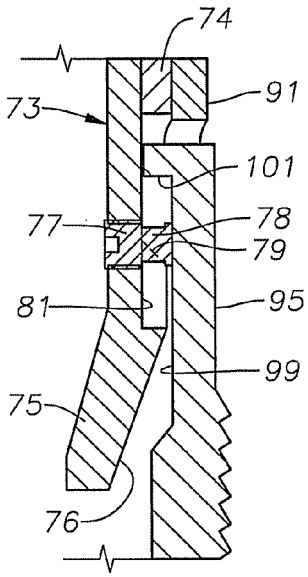
FIG. 8 is an enlarged sectional view illustrating a portion of the collet of FIG. 3 with the liner hanger in a drilling position.

Referring to FIG. 8, each slip 95 has an internal recess 99 into which one of the collet fingers 75 extends. A downward-facing shoulder 101 is at the upper end of recess 99. Heads 78 of shear elements 77 extend into recesses 99 and are positioned to contact and exert an upward force on shoulders 101 to move slips 95 upward to the set position.

In operation of the embodiments of FIGS. 1-13, liner hanger control tool 47 is shown in a run-in or drilling position with liner hanger 25 (FIG. 7). Collet finger shoulders 79 and shear member heads 78 are located in slip recesses 99. The resiliency of fingers 75 may bias them outward into in contact with inner surfaces of slips 95. The weight of liner string 19 (FIG. 1) is not supported by shear member heads 78. Rather the weight of liner string 19 is supported by drill lock tool 45 (FIG. 1) and inner string 27. Shear member heads 78 may be touching slip shoulders 101 or they may slightly below, as illustrated in FIG. 8. The outer ends of heads 78 are closely spaced and may contact the cylindrical base portions of recesses 99. During drilling, drilling fluid is pumped down drill pipe string 37 (FIG. 1). Referring to FIG. 2, the drilling fluid pressure in passage 51 causes pressurized drilling fluid to enter both ports 65 and 66 and flow into chambers 61 and 63 of liner hanger control tool 47. The same pressure acts on pistons 55, 57, 59, resulting in a net downward force that causes outer housing 53 and fingers 75 to move downward to the lower position shown in FIG. 2. In the lower position, the shoulder at the lower end of chamber 61 approaches piston 57 while sleeve 74 transfers the downward force to slips 77 (FIG. 3), maintaining slips 77 in their lower retracted position.

Figure 9:
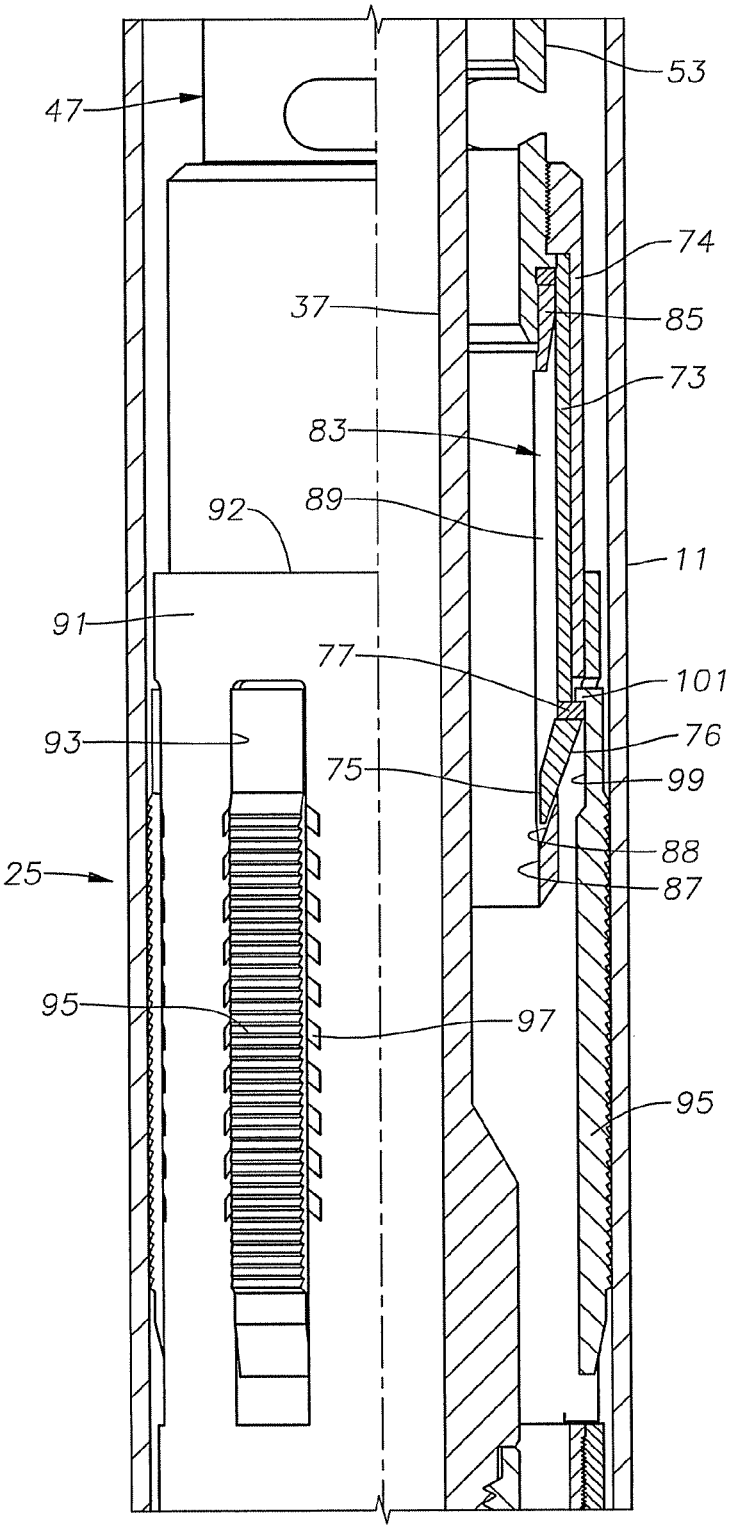
FIG. 9 is an enlarged half-sectional view of a liner hanger of FIG. 7, with the collet of FIG. 3 in engagement with the liner hanger while in a set position.
Figure 10:
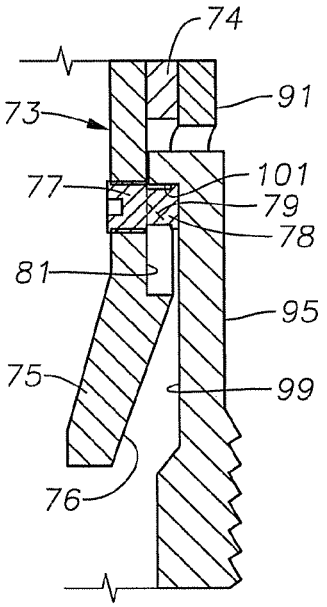
FIG. 10 is an enlarged sectional view illustrating a portion of the collet of FIG. 3 with the liner hanger in the set position.

The operator may wish to retrieve inner string 27 (FIG. 1) before reaching total depth or at total depth. To retrieve inner string 27 (FIG. 1), the operator drops a sealing element (not shown), such as a ball or dart, onto seat 69. The drilling fluid pressure is now applied only through upper port 65 to upper chamber 61 and not lower port 67. The differential pressure areas of pistons 55 and 57 cause outer housing 53 to move upward relative to mandrel 49, bringing with it collet fingers 75, as illustrated in FIG. 9. Mandrel 49, which supports the weight of the inner string 27 and liner string 19 (FIG. 1), remains stationary as outer housing 53 moves upward. Shear member heads 78 will bear against slip shoulders 101, as shown in FIG. 10, causing slips 95 to move upward and outward into contact with casing 11. Then, slacking weight off inner string 27 will cause slips 77 to grip casing 11, supporting the weight of liner 19 (FIG. 1).

Figure 11:
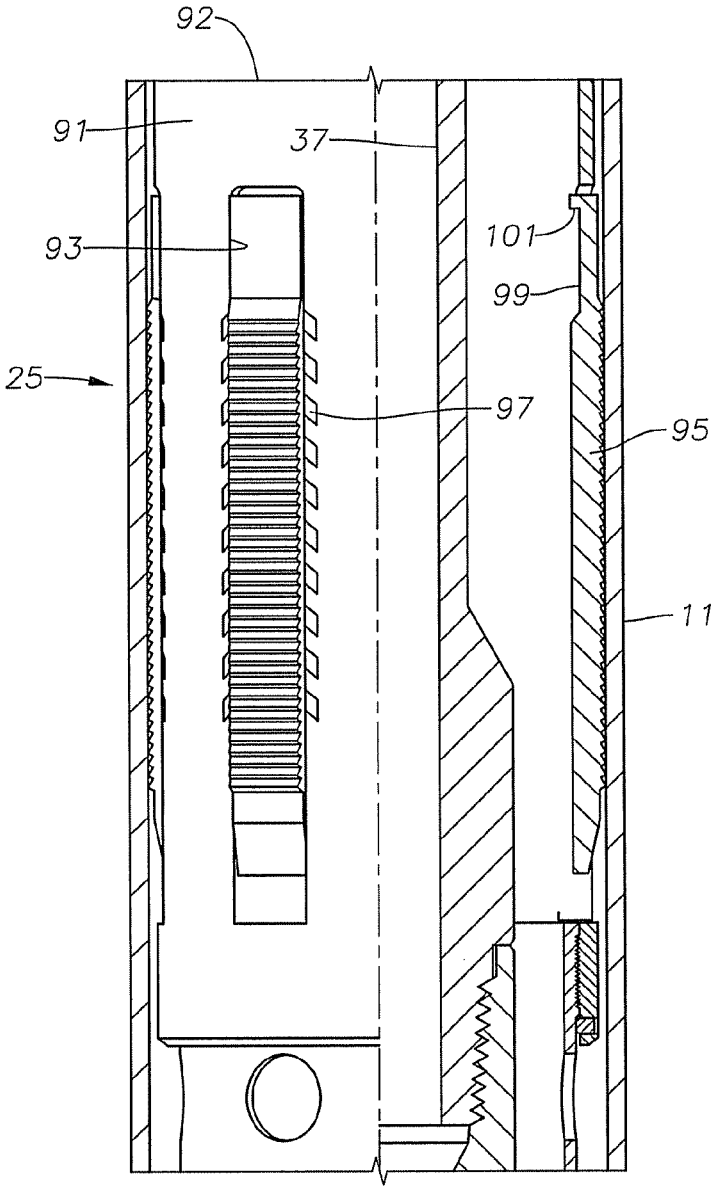
FIG. 11 is an enlarged half-sectional view of a liner hanger of FIG. 7, with the collet and the liner hanger control tool removed and the liner hanger in a set position.
Figure 12:
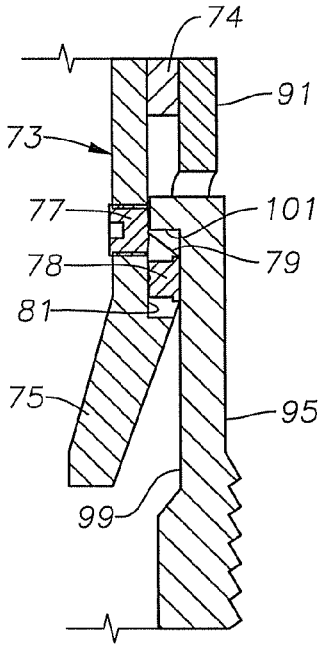
FIG. 12 is an enlarged sectional view illustrating a portion of the collet of FIG. 3 with the liner hanger in the set position and the head of a shear element sheared as the collet is disengaging from the liner hanger.

Continued upward force is applied on shear element heads 78 by liner control tool 47 (FIG. 2) in response to the drilling fluid pressure. Initially, shear element heads 78 will not let collet fingers 75 move further upward because the force against heads 78 is reacted through shoulders 101 of slips 95, which have been moved to their maximum upward position. When the upward force becomes high enough, it will cause shear element heads 78 to shear, as illustrated in FIG. 12. The severed heads 78 drop into slots 81, allowing the inclined collet finger shoulders 79 to contact slip shoulders 101. External housing 53 of liner hanger control and cage 83 move upward relative to collet 73 when shear element heads 78 shear. This upward movement brings cam surface 88 into engagement with tapered surface 76 of collet fingers 75, pushing collet fingers 75 radially inward as tapered surface 76 moves upward relative to collet fingers 75. The collet finger shoulders 79 slide past slip shoulders 101. FIG. 13 shows fingers 77 deflect inward. Collet finger shoulders 79 continue to move upward until clear of slip shoulders 101, freeing the engagement of collet 73 with slips 95. Outer housing 53 (FIG. 2) of liner hanger control tool 47 moves upward relative to mandrel 49 with collet 73 to a maximum upper position. The operator then releases drill lock tool 45 from profile nipple 21 (FIG. 1), allowing the entire inner string 27 to be retrieved while liner hanger 25 supports the weight of liner 19. FIG. 11 illustrates liner hanger 25 after the removal of inner string 27.

If the operator wishes to re-run inner string 27, he will replaced the severed shear elements 77 (FIG. 2). Liner hanger control tool 47 will appear as in FIG. 2 while re-running. Collet fingers 75 extend below outer housing 73, are biased to an expanded position by their resiliency, and are free to flex radially inward. Downward facing shoulders 101 of liner hanger slips 95 may be considered to be a wellbore shoulder into which collet fingers 75 will latch. When they reach the upper ends of liner hanger slips 95, external tapered surfaces 76 cause fingers 75 to flex inward as tapered surfaces slide past slip shoulders 101. Once finger shoulders 79 are below slip shoulders 101, collet fingers 75 snap back outward, as illustrated in FIG. 8. Shear element heads 78 do not contact the upper ends of slips 95 while being lowered downward past them because they protrude outward no farther than finger shoulders 79. Tapered surfaces 76 on fingers 75 contract fingers 75 sufficiently to prevent shear element heads 78 from striking the upper edges of slips 95. Shear element heads 78 thus remain intact during re-engagement of collet fingers 75 with liner hanger slips 95.

After re-engaging drill lock tool 45 with profile nipple 21 (FIG. 1), the operator picks up drill pipe string 37 (FIG. 1), which lifts liner hanger 25, allowing slips 95 to retract. The operator may then commence the next operation.

Figure 14:
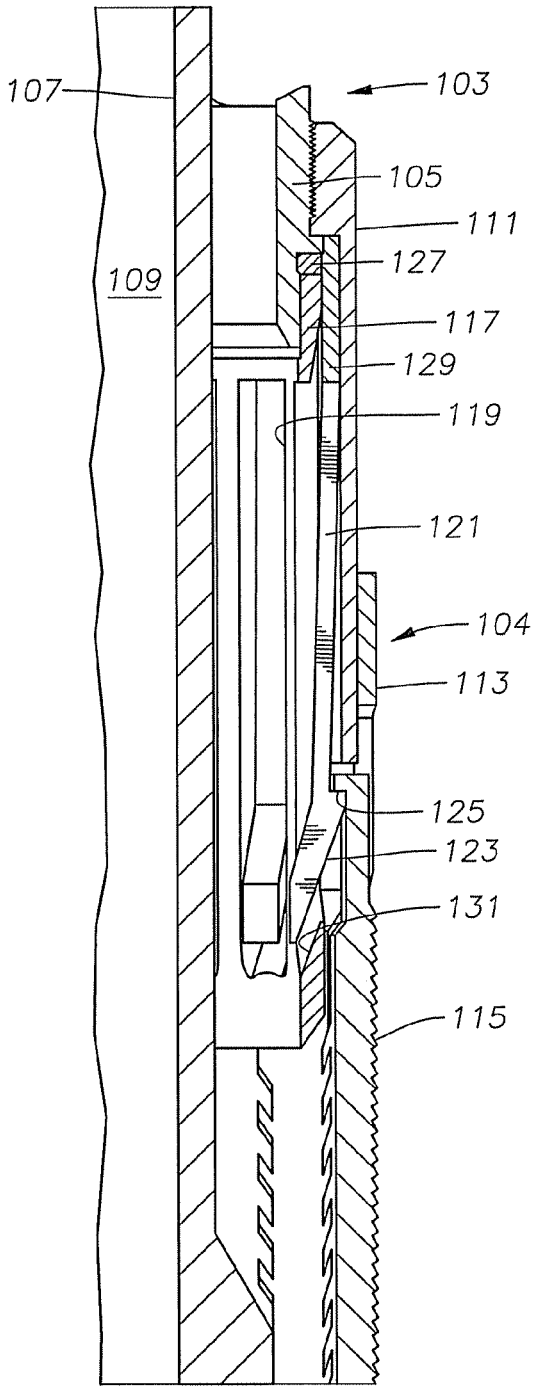
FIG. 14 is an enlarged quarter sectional view of another embodiment of a liner hanger control tool, shown supporting a liner hanger in a run-in and drilling position.
Figure 15:
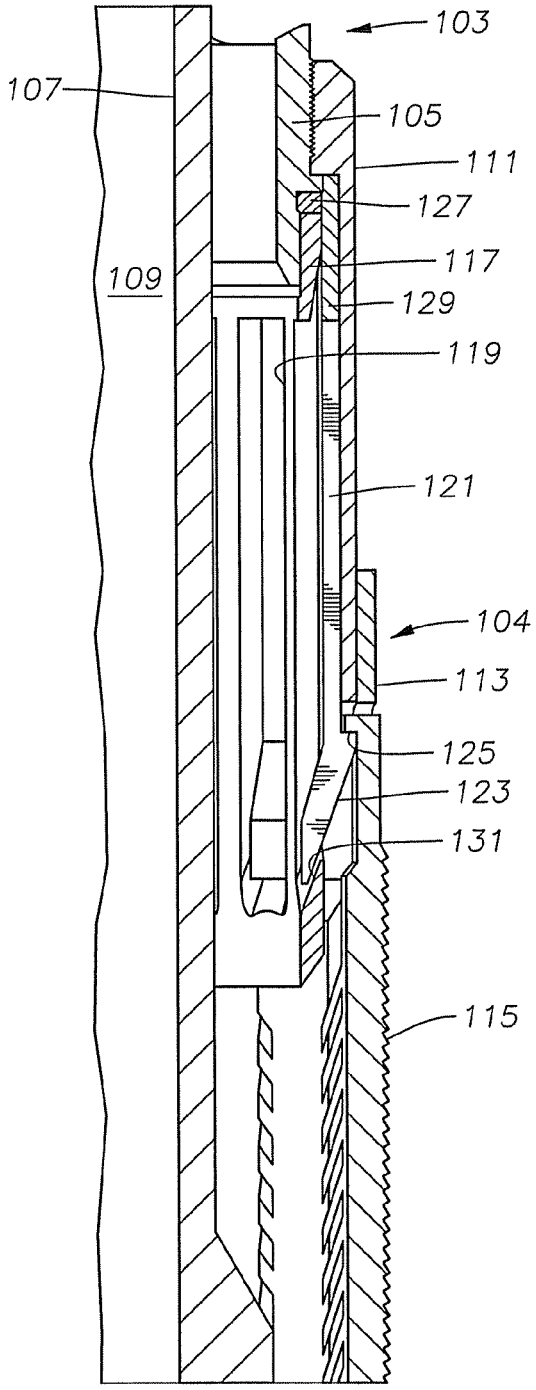
FIG. 15 is a view similar to FIG. 14, but showing the liner hanger control tool and the liner hanger in a set position.
Figure 16:
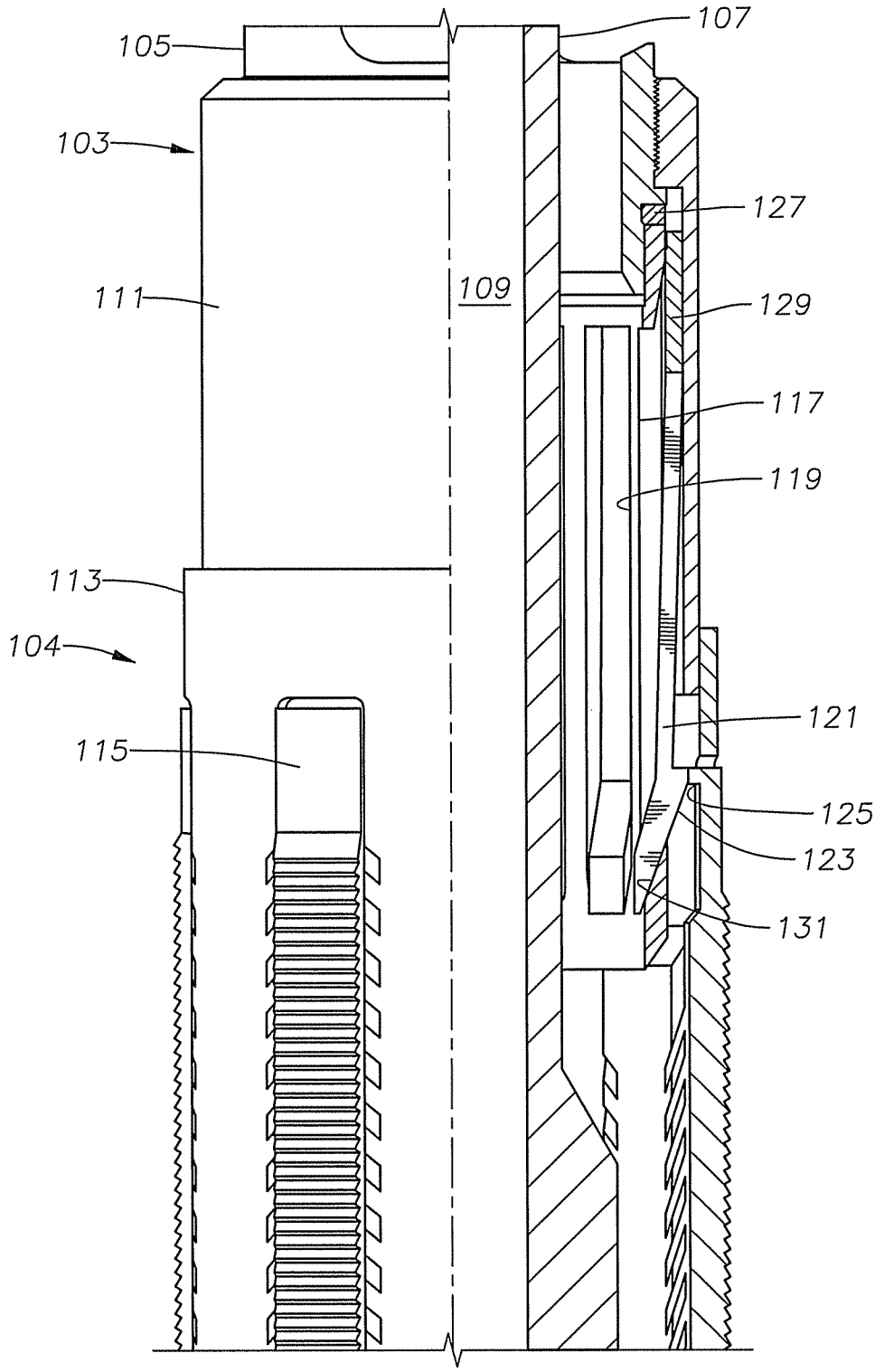
FIG. 16 is a half-sectional view of the liner hanger control tool of FIG. 14, shown in a released position from the liner hanger.

A second embodiment is illustrated in FIGS. 14-16. Liner hanger control tool 103 is the same as liner hanger control tool 47 of FIG. 2 and releasable connects to a liner hanger 104 that is the same as liner hanger 25 of FIG. 7. An outer housing 105 of liner hanger control tool 103 encloses a mandrel 107, which connects into a drill pipe string such as drill pipe string 37 (FIG. 2). A passage 109 extends through mandrel 107 and the drill pipe string. An external sleeve 111 is secured by threads to outer housing 105 and extends into the upper end of liner hanger housing 113. Slips 115 are movable carried within windows in liner hanger housing 113.

A collet cage 117 having collet windows 119 is movable and supports a collet 121. Collet cage 117 is the same as collet cage 83 (FIG. 6). Collet 121 has fingers 123 attached to flexible depending bands, which bias fingers 123 radially outward. Fingers 123 may be located within collet windows 119. Collet 121 is constructed the same as collet 73 (FIG. 3), except it does not have shear members mounted on fingers 123. Fingers 123 have upward facing shoulders that locate under downward facing slip shoulders 125, as shown in FIG. 14 during the run-in and drilling position.

One or more shear pins 127 secure collet 121 in the run-in and drilling position shown in FIG. 14. Shear pins 127 are mounted between outer housing 105 and an upper ring or circular band portion 129 of collet 121. When pinned by shear pin 127, collet 121 cannot move axially relative to liner control tool outer housing 105. When pinned by shear pines 127 to outer housing 105, the lower ends of fingers 123 will be spaced above an inward and upward facing ramp or cam surface 131 within cage 117.

The embodiment of FIGS. 14-16 operates in the same manner as the first embodiment, differing only in the location of shear pins 127. As mentioned, FIG. 14 shows the run-in and drilling position. The weight of the drill string and liner string below mandrel 107 is supported by mandrel 107, not by collet 121. When liner hanger control tool 103 sets liner hanger 104, it will appear as in FIG. 15, with shear pin 127 still unsheared. Liner control tool outer housing 105, along with external sleeve 111, collet cage 117 and collet 121 have moved upward in unison relative to mandrel 107. Liner hanger housing 113, which is attached to the upper end of the liner string, remains stationary. This movement causes collet fingers 123 to lift slips 115, which forces them radially outward to the set position of FIG. 15. Then, slacking weight off the drill pipe string will cause slips 115 to grip the casing, supporting the weight of the liner string.

Continued upward force is applied on shear pins 127 by liner control tool 103 in response to the drilling fluid pressure. When the upward force becomes high enough, it will cause shear pins 127 to shear, as illustrated in FIG. 16. Control tool housing 105 and cage 83 move upward a short distance relative to collet 121. Ramps 131 of cage 117 now engage collet fingers 123 and cause fingers 123 to deflect inward and slide past slip shoulders 125. Slip shoulders 125 are set against the casing and thus cannot move upward. Before shearing shear pins 127, the upward force of the upper shoulders on collet fingers 123 against slip shoulders 125 would not cause fingers 123 to deflect inward because of the outward bias on fingers 123.

Collet 121 of liner hanger control tool 103 is disengaged from liner hanger 104 in FIG. 14. After the inner string is disengaged from the liner string, as discussed in connection with the first embodiment, liner hanger control tool 103, drill pipe strings and the inner string may be retrieved. If liner hanger control tool 103 is to be re-run, shear pins 127 will be re-installed at the surface. As liner hanger control tool 103 lands in liner hanger 104, fingers 123 are free to radially contract and snap past the slip shoulders 125 with the shear pins 127 intact.

The combination of shear elements with collet fingers results in a more precise disengagement of the collet fingers from the slips than if one relies only on deflection of the fingers to release. The shear elements will shear at a narrower range of force than forces required to snap collet fingers upwardly past a shoulder.

While the system has been shown in only a few of its forms, it should be apparent to those skilled in the art that it is not so limited but susceptible to various changes. For example, rather than collet fingers, the latch could be a deflectable split ring. Also, although shown in connection with deploying a liner string, the use of shear elements with a deflectable latch or collet could be employed for latching and releasing downhole tools for other purposes.

The invention claimed is:

1. A well tool apparatus, comprising:

a running tool having an axis and configured to be carried by a running string into and out of a wellbore;

a collet carried by the running tool, the collet having a plurality of fingers with a radially expanded position arranged to latch against a wellbore shoulder in the wellbore, preventing upward movement of the running tool, the plurality of fingers of the collet being resiliently and radially contractible to unlatch the running tool;

a shear element carried by the collet, the shear element preventing the plurality of fingers of the collet from radially contracting to unlatch the running tool while the shear element is intact, and freeing the plurality of fingers of the collet to radially contract to unlatch the running tool if a selected axial force is applied against the shear element, causing the shear element to shear;

a collet cage carried by the running tool and having a plurality of windows, each of the plurality of fingers of the collet protruding partially inward into a respective window of the plurality of windows, the collet cage being prevented from axial movement relative to the collet while the shear element is intact, and the collet cage being axially movable after the shear element has sheared, with upward axial movement of the collet cage relative to the collet being configured to cause the plurality of fingers of the collet to deflect radially inward; and an inward and upward facing cam surface on the collet cage below the plurality of fingers of the collet.

2. The apparatus according to claim 1, wherein:

the running tool has a hydraulic mechanism operable in response to hydraulic fluid pressure applied to the running string to exert the selected axial force on the shear element.

3. The apparatus according to claim 1, wherein:
the collet has an upper annular band; and
the shear element comprises a pin located between the annular band and the running tool.

4. The apparatus according to claim 1, wherein:
each of the plurality of fingers of the collet has an external upward-facing shoulder;
the shear element comprises a plurality of shear elements, each mounted to one of the plurality of fingers of the collet with at least a portion located above the upward-facing shoulder, each of the shear elements having a head that protrudes radially outward from at least one of the plurality of fingers of the collet approximately to an outer extent of the upward-facing shoulder for engagement with the wellbore shoulder; and
an axially extending elongated slot extends downward from each of the shear elements within the plurality of fingers of the collet to which the shear elements are mounted.

5. The apparatus according to claim 1, wherein:
the shear element comprises a plurality of shear elements; and
each of the shear elements comprises a pin with an inner end flush with an inner surface of the collet and an outer end protruding outward from an outer surface of the collet.

6. The apparatus according to claim 1, wherein the plurality of fingers of the collet are free to radially contract and snap past the wellbore shoulder with the shear element intact when the running tool moves downward in the wellbore.

7. The apparatus according to claim 1, wherein the shear element is fastened only to the collet and not to any other components of the running tool and not to the wellbore shoulder.

8. The apparatus according to claim 1, wherein the shear element comprises:
a plurality of shear elements spaced around the collet, each having a head protruding out from the collet for engagement with the wellbore shoulder; and
the selected axial force applied against the shear elements is reacted by the wellbore shoulder.

9. A well tool apparatus for releasably latching a string of drill pipe to a string of liner in a wellbore, comprising:
a liner hanger having a lower end configured to be secured to the string of liner, the liner hanger having an axis, the liner hanger having a set of slips, the slips being radially movable between a disengaged position to a set position in engagement with a casing string in the wellbore in response to axial movement of the slips;
a running tool having a mandrel with an upper portion configured to be secured to the string of drill pipe;
a latch carried by and axially movable relative to the running tool, the latch comprising a collet, the collet comprising a plurality of fingers, each of the plurality of fingers of the collet comprising an external upward-facing shoulder, the latch being radially resilient and biased to a radially expanded position, and the latch having a latched position in which the latch is latched to the slips;
a collet cage carried by the running tool, the collet cage comprising a plurality of windows, each of the plurality of fingers of the collet protruding partially inward into a respective window of the plurality of windows;
an inward and upward facing cam surface on the collet cage below each of the plurality of fingers of the collet; and
a shear element mounted directly to the latch, the running tool configured to axially move the latch to shift the slips to the set position and the collet cage being prevented from axial movement relative to the collet while the shear element is intact, and the latch being axially movable relative to the slips to release the latch from the latched position and the collet cage being axially movable after the shear element has sheared, with upward axial movement of the collet cage relative to the collet being configured to cause the plurality of fingers of the collet to deflect radially inward, the shear element being shearable by a selected axial force applied to the latch after the slips are in the set position.

10. The apparatus according to claim 9, wherein:
the slips move upward relative to the liner hanger when moving to the set position; and the axial force applied to the latch is an upward force.

11. The apparatus according to claim 9, wherein:
the running tool is engageable with the liner hanger while the slips are in the set position by lowering the running tool onto the liner hanger; and
the latch is free to radially contract and snap past a shoulder of the slips with the shear element intact.

12. The apparatus according to claim 9, wherein:
the shear element comprises a plurality of shear elements, each mounted to one of the plurality of fingers above the upward-facing shoulder and having a head that protrudes radially outward from the one of the plurality of fingers into engagement with one of the slips.

13. The apparatus according to claim 12, wherein:
the shear element comprises a shear pin connected between an upper annular portion of the collet and the running tool.

14. A method of manipulating well tools, comprising:
(a) providing a running tool having a mandrel, an axially movable latch that is radially resilient and biased to a radially expanded position, and at least one shear element mounted directly to the latch;
(b) attaching a liner hanger to a string of liner, the liner hanger having a set of slips;
(c) mounting the mandrel and a collet cage to a running string and lowering the running tool into the liner hanger, causing the latch to snap into engagement with the slips while the shear element remains intact; then to set the liner hanger and release the running tool from the liner hanger, wherein the shear element while intact prevents axial movement of the collet cage relative to a collet of the running tool;
(d) applying an axial force to the latch, which causes the latch to move relative to the mandrel to move the slips to the set position; and
(e) shearing the shear element with the axial force, causing the latch to release from the slips.

15. The method according to claim 14, wherein:
step (a) comprises mounting a plurality of the shear elements around the latch, each having a head that protrudes radially outward from the latch;
step (c) comprises positioning the shear elements against shoulders formed on the slips;
step (d) comprises transferring the axial force through the heads of the shear elements to the shoulders on the slips; and
step (e) comprises continuing to transfer the axial force through the heads of the shear elements after the slips have set until the heads shear from the shear elements.

16. The method according to claim 14, wherein:
step (a) comprises mounting the collet to the mandrel, the collet having an annular upper band and a plurality of collet fingers with shoulders, and mounting a shear pin between the annular upper band and the running tool.

17. The method according to claim 16, wherein:

step (e) comprises moving a cam surface with the mandrel and relative to the collet, engaging the cam surface with the plurality of collet fingers, and deflecting the plurality of collet fingers inward.

18. The method according to claim 14, wherein step (c) also comprises coupling the mandrel to the string of liner independently of the engagement of the latch with the slips.

19. The method according to claim 14, wherein the latch includes the collet.

20. A well tool apparatus, comprising:

a running tool having an axis and configured to be carried by a running string into and out of a wellbore;

a collet carried by the running tool, the collet having a plurality of fingers each of which has an elongated slot extending axially therein, the plurality of fingers of the collet being in a radially expanded position arranged to latch against a wellbore shoulder in the wellbore and to restrict upward movement of the running tool, the plurality of fingers of the collet being resiliently and radially movable to unlatch the running tool, and the plurality of fingers of the collet each having an external upward-facing shoulder; and a plurality of shear elements carried by the collet, each of the plurality of shear elements being mounted to one of the plurality of fingers such that at least a portion thereof is located above the upward-facing shoulder with the elongated slot extending axially downward therefrom, each of the plurality of shear elements having a head protruding radially outward from at least one of the plurality of fingers approximately to an outer extent of the upward-facing shoulder for engagement with the wellbore shoulder, wherein the plurality of shear elements restrict the plurality of fingers from moving radially to unlatch the running tool while the shear element is intact, while also being configured to shear upon application of a selected axial force, thereby freeing the plurality of fingers to move radially to unlatch the running tool.

* * * * *